United States Patent [19]

Mathur et al.

[11] Patent Number: 4,905,758

[45] Date of Patent: Mar. 6, 1990

[54] PLATE HEAT EXCHANGER

[75] Inventors: Achint P. Mathur, Wichita Falls, Tex.; Virgil F. Gates, Augusta, Ga.

[73] Assignee: Tranter, Inc., Augusta, Ga.

[21] Appl. No.: 375,190

[22] Filed: Jul. 3, 1989

[51] Int. Cl.[4] ..... F28F 3/10

[52] U.S. Cl. ..... 165/166; 165/167

[58] Field of Search ..... 165/166, 167

[56] References Cited

U.S. PATENT DOCUMENTS

| | | | |
|---|---|---|---|
| 4,377,204 | 3/1983 | Johansson | 165/166 |
| 4,432,415 | 2/1984 | Wright | 165/166 |
| 4,635,715 | 1/1987 | Andersson | 165/167 |

FOREIGN PATENT DOCUMENTS

| | | | |
|---|---|---|---|
| 33392 | 7/1974 | Japan . | |
| 46344 | 11/1977 | Japan . | |
| WO87/01189 | 2/1987 | PCT Int'l Appl. | 165/166 |
| 2028996B | 3/1980 | United Kingdom . | |
| 2075656B | 11/1981 | United Kingdom . | |
| 2117890A | 10/1983 | United Kingdom . | |
| 2138931B | 10/1984 | United Kingdom . | |
| 2189590A | 2/1987 | United Kingdom . | |

*Primary Examiner*—Martin P. Schwadron
*Assistant Examiner*—Allen J. Flanigan
*Attorney, Agent, or Firm*—Barnes, Kisselle, Raisch, Choate, Whittemore & Hulbert

[57] ABSTRACT

A heat exchanger plate having a main groove spaced inwardly from the edge of the plate, and sub-grooves extending from the main groove toward the plate edge. Openings are provided in opposite sides of each sub-groove. A gasket of flexible, compressible material has a main body portion seated in the main groove and integral tabs seated in the sub-grooves with the sides of the tabs projecting into the openings to provide a snap-in connection. The sub-grooves above and between the sub-groove openings are completely open and unobstructed to permit the tabs to be pressed downwardly thereinto.

11 Claims, 2 Drawing Sheets

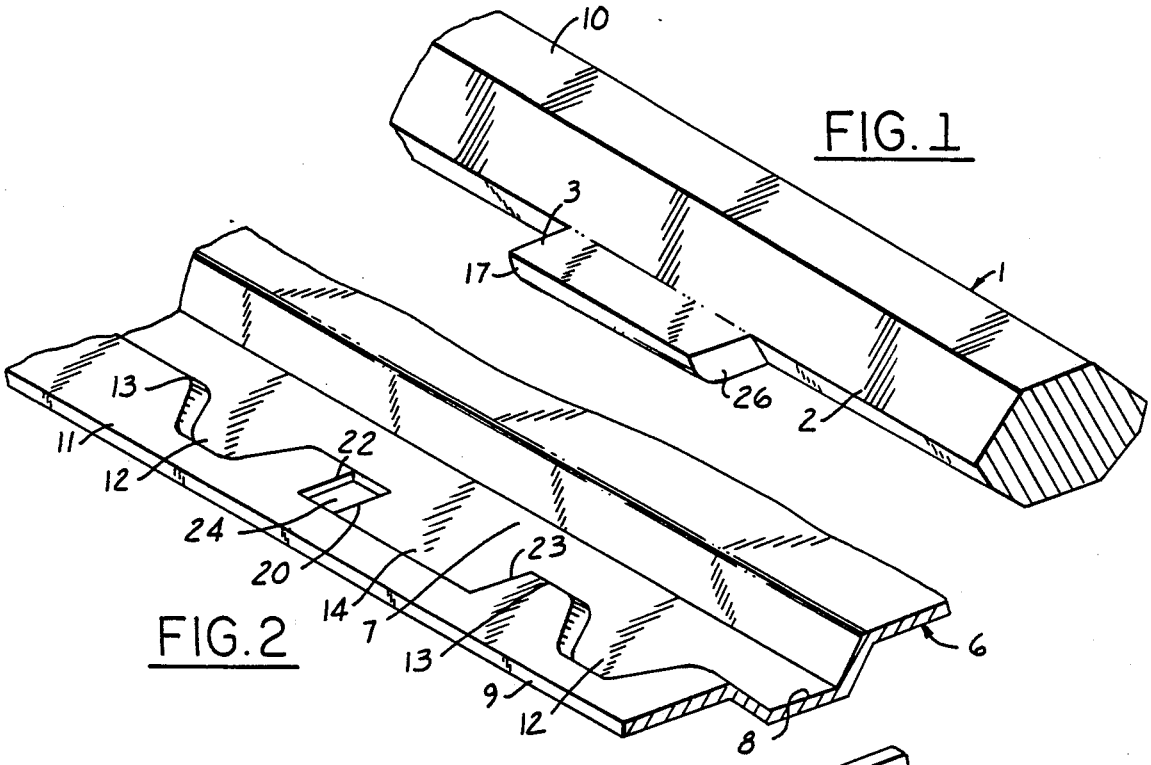
FIG. 1
FIG. 2
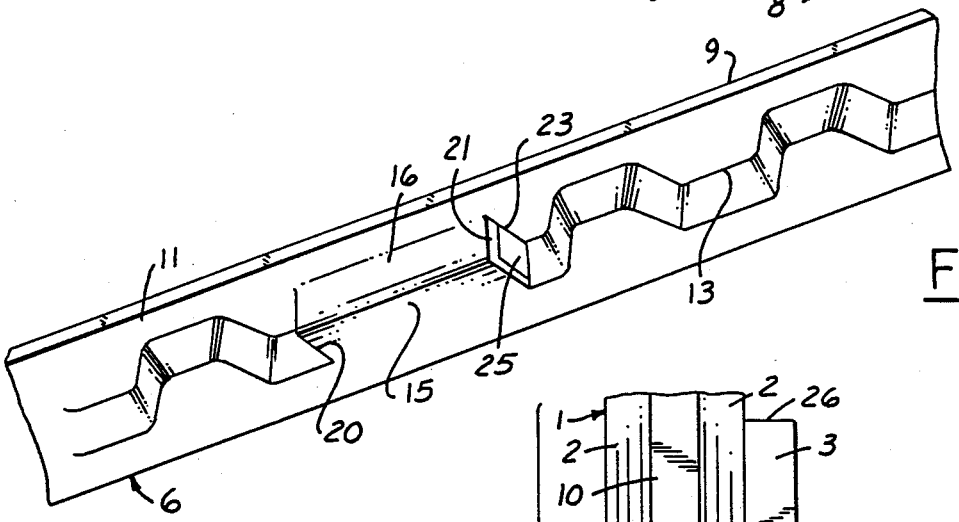
FIG. 3
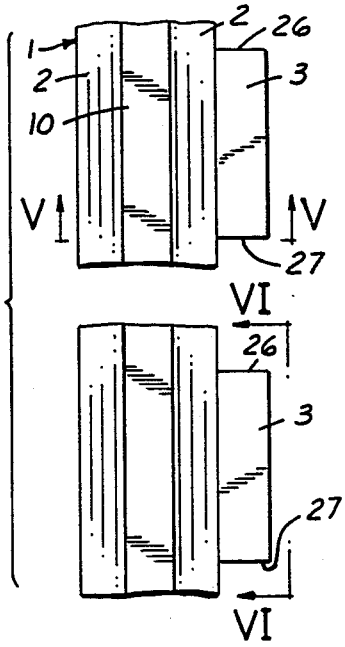
FIG. 4
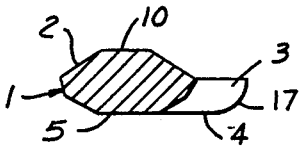
FIG. 5
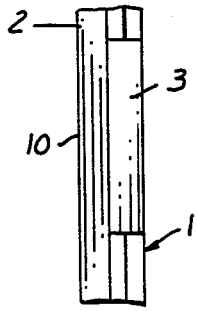
FIG. 6

PLATE HEAT EXCHANGER

This invention relates generally to plate heat exchangers and refers more particularly to a plate heat exchanger having heat exchanger plates provided with one or more grooves in which sealing gaskets are located.

BACKGROUND AND SUMMARY OF THE INVENTION

A plate and frame heat exchanger consists of several corrugated heat transfer plates which are clamped together between a stationary frame and a movable frame. The plates with their gaskets hang vertically from a horizontal carrying bar. To insure that the gaskets will not fall off the vertical plates during assembly and disassembly, the gaskets must be held in place prior to hanging of the plates on the carrying bar.

Heat exchanger plates are generally of two types. In one type, the gaskets are held in the gasket groove by means of a continuous line of glue. In the other type, the gaskets are held in the groove by a snap-in connection. One example of a snap-in connection is shown in U.S. Pat. No. 4,377,204.

The present invention relates to a snap-in type connection in which the gasket has integral tabs which engage in sub-grooves outside of the main gasket groove in the plate.

In accordance with the construction described hereinafter, the heat exchanger plate has an elongated main groove spaced inwardly from an edge of the plate. A plurality of sub-grooves spaced apart longitudinally of the main groove extend toward the plate edge. Openings are provided in the plate which open into opposite sides of each sub-groove. A gasket of flexible, compressible material has an elongated main body portion seated in the main groove. Tabs integral with the main body portion are seated in the sub-grooves and project into the openings to provide a snap-in connection. Each sub-groove above and between the openings is unobstructed to permit the tabs to be inserted in the sub-grooves by being pressed downwardly thereinto.

The openings into each sub-groove may be formed by lancing the plate without any removal of metal.

Objects of this invention include the provision of a snap-in type connection which has the foregoing features, which is inexpensive to manufacture, and which will permit the intermixing of the plates of this invention with existing plates having glued gaskets.

BRIEF DESCRIPTION OF THE DRAWINGS

FIG. 1 is an isometric view with parts broken away of a portion of a gasket constructed in accordance with this invention.

FIG. 2 is an isometric view of a portion of a heat exchanger plate also constructed in accordance with this invention, as seen from one side of the plate.

FIG. 3 is an isometric view of a portion of the heat exchanger plate shown in FIG. 2, as seen from the opposite side thereof.

FIG. 4 is a fragmentary top plan view with portions broken away of the gasket shown in FIG. 1.

FIG. 5 is a sectional view taken on the line V—V in FIG. 4.

FIG. 6 is a view taken on the line VI—VI in FIG. 4.

DETAILED DESCRIPTION

Figure 7:
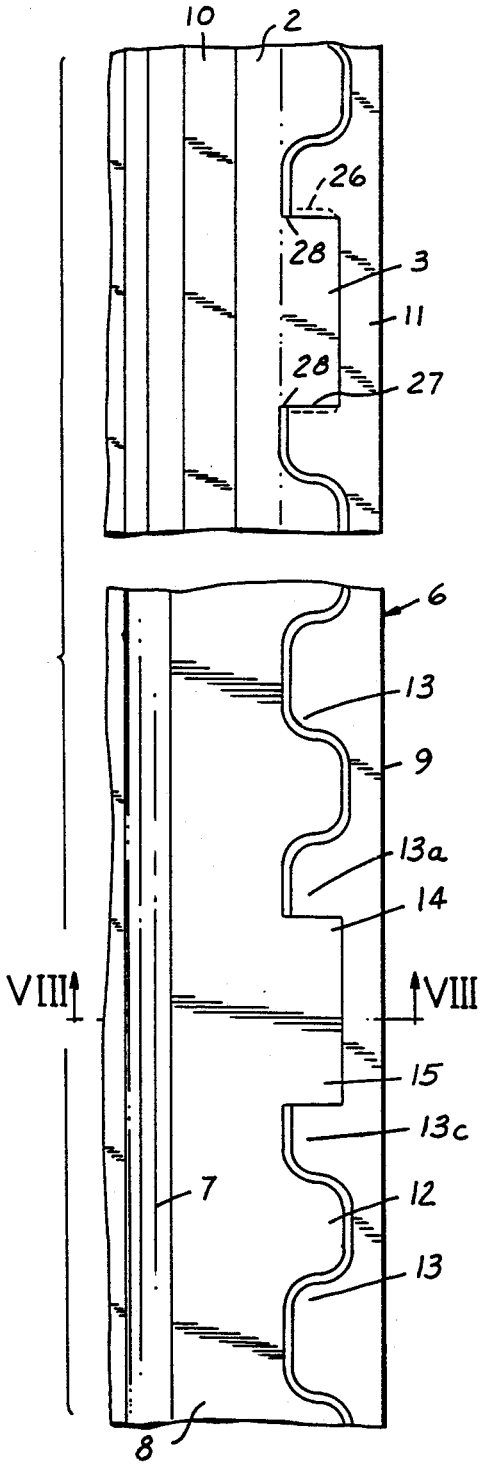
FIG. 7 is a fragmentary top plan view of the heat exchanger plate a portion of which shows the gasket seated in the main gasket groove with a tab extending into a sub-groove, and another portion of which shows the heat exchanger plate with the gasket removed.
Figure 8:
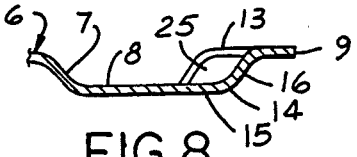
FIG. 8 is a sectional view taken on the line VIII—VIII in FIG. 7.

Referring now more particularly to the drawings, and especially to FIG. 1–8 thereof, there is shown a gasket 1 formed of flexible, compressible material and having an elongated main body portion 2 provided with integral tabs 3. The tabs 3 are spaced apart and project laterally from the main body portion 2 of the gasket on the side of the main body portion remote from the heat exchange area of the plate to be sealed. The bottoms 4 of the tabs 3 are flat and flush with the flat sealing surface 5 on the bottom of the main body portion 2.

A heat exchanger plate 6 has an elongated main groove 7 which extends around the perimeter of the plate and also around any portholes in the plate. The main body portion 2 of the gasket is adapted to lie in the main groove 7 with its underside 5 in sealing engagement with the flat bottom 8 of the main groove to provide a sealed heat exchange area inside the gasket, that is, on the side of the gasket away from the plate edge 9. The main body portion 2 of the gasket also has a flat sealing surface 10 along the top which abuts and seals against the heat exchanger plate in front of it.

The main groove 7 is spaced inwardly from the edge 9 of the plate and is depressed downwardly relative to the marginal plate portion 11 between the main groove 7 and the plate edge. The side wall of the groove nearest to the plate edge is corrugated or scalloped in a serpentine pattern as viewed in FIG. 7 to provide extensions 12 of the main groove 7 which extend into the marginal plate portion 11 and the bottoms of which lie in the same plane as the bottom of the main groove 6. The scalloping of the side wall of the main groove 7 is for the purpose of strengthening the plate. The marginal plate portion 11 between extensions 12 provide dimples 13.

The plate 6 is also shaped to provide sub-grooves 14 which have downwardly depressed portions 15 extending from the main groove 7 into the marginal plate portion 11. The downwardly depressed portion or bottom wall 15 of each sub-groove 14 is an extension of and is in the same plane as the bottom wall of the main groove 7. These sub-grooves 14 are spaced apart the same distances as the tabs 3 of the gasket in order to receive the tabs when the main body portion 2 of the gasket is placed in the main groove 7. The outer extremities 16 of the downwardly depressed portions 15 of sub-grooves 14 are inclined upwardly and blend into the marginal plate portion 11. The outer extremities 17 of the bottoms of the tabs 3 are inclined upwardly at the same angle as extremities 16 and contact extremities 17 of the tabs when the tabs are received in sub-grooves 14.

Each sub-groove 14 is formed by lancing or slitting two dimples, such as the dimples 13*a* and 13*c*, and depressing the plate metal between the slits (which includes half of dimples 13*a* and 13*c* and all of a dimple between dimples 13*a* and 13*c*) down to the level of the bottom of the main groove 7. The slit lines extend at right angles to the longitudinal centerline of the main groove 7.

The lancing or slitting defines the opposite side edges 20 and 21 of the depressed portion 15 and outer extremity 16 of each sub-groove. Edges 20 and 21 extend from the main groove 7 to the marginal plate portion 11. Such lancing or slitting also defines edges 22 and 23 of the marginal plate portion 11 on either side of each sub-groove which connect end-to-end with the respective edges 20 and 21 to form openings 24 and 25 through the plate.

Each tab 3 has parallel opposite sides 26 and 27 which are in planes at right angles to the longitudinal centerline of the main body portion 2 of the gasket. The width of the sub-grooves 14 (the distance between the edges 20–23 and hence between the openings 24 and 25 defined thereby) is slightly less than the width of the tabs 3 (the distance between tab sides 26 and 27). Hence, when the tabs 3 are received in the sub-grooves 14, the sides of the tabs project into openings 24 and 25. Thus it can be said that the tabs 3 have an interference fit in the sub-grooves 14 and are actually compressed at the entry to the sub-grooves where indicated at 28.

Each sub-groove 14 above and between the openings 24 and 25 is completely open and unobstructed to permit a tab 3 to be pressed downwardly thereinto.

To assemble the gasket 1 with the plate 6, the main body portion 2 is placed in the main groove 7 with the tabs 3 registering with or overlying the sub-grooves 14. Then the tabs are pressed downwardly either by hand or with a tool into the sub-grooves. The flexible and compressible nature of the tabs enables them to distort and compress and snap into the sub-grooves, their sides then popping out into the openings 24 and 25. The assembly is complete after all tabs are pressed into the sub-grooves in this manner. No other securing means are required to hold the gasket in assembly with the plate.

Figure 9:
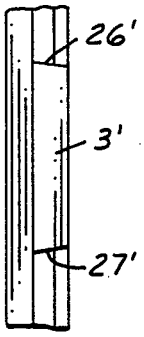
FIG. 9 is a view similar to FIG. 6 but shows a modification.

FIG. 9 shows a modification in which the tabs 3' are the same as the tabs 3 in the first embodiment, except that the sides 26' and 27' are beveled or tapered so that they are wider at the top than at the bottom. The width of the tabs 3' measured across the top is the same as the width of tabs 3, and thus slightly greater than the width of the sub-grooves 14. The width of the tabs 3' measured across the bottom may be equal to or slightly less than the width of the sub-grooves 14. Accordingly, the tabs 3' when pressed downwardly into the sub-grooves 14, will enter and snap into the sub-grooves more readily because of the taper and piloting action of the sides 26' and 27'. Otherwise, the embodiment of FIG. 9 is like the embodiment of FIGS. 1–8.

Figure 10:
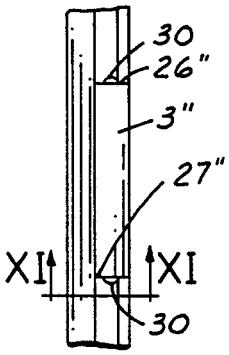
FIG. 10 is a view similar to FIG. 6, showing a further modification.
Figure 11:
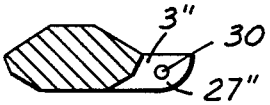
FIG. 11 is a sectional view taken on the line XI—XI in FIG. 10.

FIGS. 10 and 11 show a further modification in which the tabs 3'' are the same as tabs 3 in that the sides 26'' and 27'' are parallel and at right angles to the longitudinal centerline of the main body portion 2 of the gasket, but different in that the distance between sides 26'' and 27'' is slightly less than the distance between sides 26 and 27 of tabs 3. Actually, the distance between sides 26'' and 27'' may be equal to or slightly less than the width of the sub-grooves 14. Tabs 3'' differ further in that an integral nub 30 is formed on each of the sides 26'' and 27''. The nubs 30 may be of any shape, but are here shown as hemispherical. The overall width of each tab 3'' measured from nub to nub is substantially the same as the width of tabs 3, which is somewhat greater than the width of the sub-grooves 14. The tabs 3'' when pressed downwardly into the sub-grooves 14 will enter and snap into the sub-grooves more readily because of the piloting action of the sides 26'' and 27'' and because of the camming action of the nubs which compress upon entry and the pop out into the openings 24 and 25.

As a variation on FIGS. 10 and 11, the tabs 3'' may have a nub 30 on only one of the sides 26'', 27''. The overall width of the tabs 3'' with single nubs would still be somewhat greater than the width of the sub-grooves to insure a snap in connection.

Figure 12:
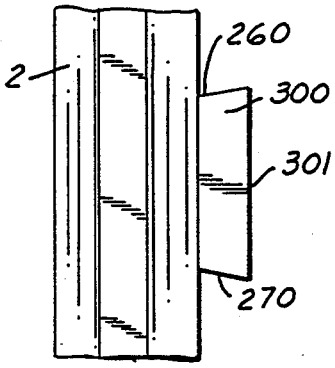
FIGS. 12 and 13 are views similar to FIG. 4, showing additional modifications.

FIG. 12 shows still another modification in which the tabs 300 are the same as tabs 3 in the first embodiment except that the sides 260 and 270 are dovetailed so that they are wider at the outer edge 301 of the tabs than at the point where the tabs join the main body portion 2 of the gasket. The width of the tabs 300 measured along the outer edge 301 is the same as the width of the tabs 3, and thus slightly greater than the width of the sub-grooves 14. The width of the tabs 300 measured at the point where they are joined to the main body portion 2 may be equal to or slightly less than the sub-grooves 14. Thus, the tabs 300 when pressed downwardly into the sub-grooves 14 will enter into the sub-grooves with a snap action.

Figure 13:
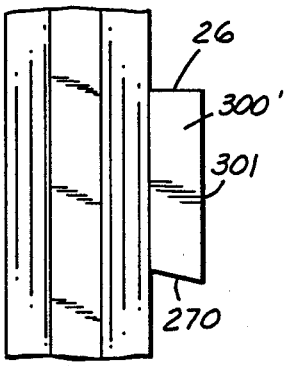

FIG. 13 shows a still further modification in which the tabs 300' are the same as the tabs 3 in the first embodiment except that only one side 270 is dovetailed as in FIG. 12, the other side 26 being like the correspondingly numbered side in FIG. 4 and thus disposed in a plane at right angles to the longitudinal centerline of the main body portion 2. The width of the tabs 300' measured across the outer edge 301 is the same as the width of the tabs 3, and may also be the same as the width of the tabs 300 measured across their outer edges. Tabs 300' when pressed downwardly will enter the sub-grooves 14 with a snap action, as in the embodiments previously described.

A plurality of heat exchanger plates with snap-in gaskets of the construction shown in FIG. 1–8, or as modified in FIG. 9, or as modified in FIGS. 10 and 11, including the variation described herein, or as modified in FIGS. 12 and 13, may be clamped between stationary and movable frames to form a plate and frame heat exchanger. Likewise, a plate and frame heat exchanger can be formed by intermixing plates with gaskets having any combination of the snap-in constructions shown or described. Also, a plate and frame heat exchanger can be formed by intermixing plates with gaskets having any of these snap-in constructions with plates having glued gaskets.

What is claimed:

1. In combination, a heat exchanger plate having an elongated main groove spaced inwardly from an edge of said plate and depressed downwardly relative to a marginal plate portion between said groove and said plate edge, a plurality of sub-grooves spaced apart longitudinally of said main groove, each sub-groove having a downwardly depressed portion extending from said main groove into said marginal plate portion, said depressed portion of each sub-groove having edges spaced apart longitudinally of said main groove and extending from said main groove at one end to said marginal plate portion at the other end, said marginal plate portion having edges adjacent each sub-groove connected end-to-end with said respective edges of the depressed portion of said sub-groove to define sub-groove openings through said plate, and a gasket of flexible, compressible material having an elongated main body portion seated in said main groove, said gasket having tabs integral with said main body portion seated in said respective sub-grooves and projecting into said openings, each sub-groove above and between said openings thereof being unobstructed to permit said tabs to be inserted in said sub-grooves by being pressed downwardly thereinto.

2. The combination defined in claim 1, wherein the width of each sub-groove measured between the openings thereof is slightly less than the width of said tab seated therein.

3. The combination defined in claim 1, wherein the sides of each tab are parallel to one another and disposed in planes at right angles to the longitudinal centerline of said main body portion, and the width of each sub-groove between the openings thereof is slightly less than the width of said tabs.

4. The combination defined in claim 1, wherein the sides of said tabs are tapered so as to be wider at the top than at the bottom, and the width of each sub-groove between the openings thereof is slightly less than the width of the top of said tab seated therein.

5. The combination defined in claim 1, wherein each tab includes a nub projecting from one of the two opposite sides thereof, and the width of each sub-groove is slightly less than the overall width of the tab, including said nub, seated therein.

6. The combination defined in claim 1, wherein each tab includes a nub projecting from each of the two opposite sides thereof, and the width of each sub-groove is slightly less than the width of the tab seated therein measured from one nub thereof to the other.

7. The combination defined in claim 1, wherein one side of each tab is dovetailed so that said tabs are wider at their outer edges than where joined to said main body portion, the width of said sub-grooves measured between the openings thereof being slightly less than the width of the tabs seated therein measured at the outer edges of said tabs.

8. The combination defined in claim 1, wherein both sides of each tab are dovetailed so that said tabs are wider at their outer edges than where joined to said main body portion, the width of said sub-grooves measured between the openings thereof being slightly less than the width of said tabs seated therein measured at the outer edges of said tabs.

9. The combination defined in claim 1, wherein said connected edges of said depressed portions of said sub-grooves and said marginal plate portions are disposed in planes substantially at right angles to the plane of said plate.

10. The combination defined in claim 1, wherein said openings are formed by lancing said plate on opposite sides of each said sub-groove.

11. A heat exchanger plate and gasket as defined in claim 1, constructed and arranged to be combined with others of like construction or intermixed with plates having glued gaskets to form a plate and frame heat exchanger.

* * * * *